US006551128B2

(12) United States Patent
Asai

(10) Patent No.: US 6,551,128 B2
(45) Date of Patent: Apr. 22, 2003

(54) CONNECTOR FOR CONNECTING FLEXIBLE SUBSTRATES

(75) Inventor: Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/007,802

(22) Filed: Dec. 3, 2001

(65) Prior Publication Data

US 2002/0081884 A1 Jun. 27, 2002

(30) Foreign Application Priority Data

Dec. 7, 2000 (JP) ..... 2000-372875

(51) Int. Cl.[7] ..... H01R 12/24
(52) U.S. Cl. ..... 439/495; 439/260
(58) Field of Search ..... 439/260, 495, 439/496, 329

(56) References Cited

U.S. PATENT DOCUMENTS 4,778,403 A * 10/1988 Ikesugi et al. ..... 439/329
5,397,247 A * 3/1995 Aoki et al. ..... 439/495
6,352,442 B1 * 3/2000 Kudo ..... 439/260
6,056,572 A * 5/2000 Matsumoto et al. ..... 439/260
6,280,217 B1 * 8/2001 Lin ..... 439/260
6,319,033 B1 * 11/2001 Ma ..... 439/260
6,319,052 B1 * 11/2001 Chang ..... 439/495

FOREIGN PATENT DOCUMENTS

JP 517968 3/1993

* cited by examiner

*Primary Examiner*—P. Austin Bradley
*Assistant Examiner*—Briggitte Hammond
(74) *Attorney, Agent, or Firm*—Darby & Darby

(57) ABSTRACT

A connector for securely and electrically connecting flexible substrates requires zero insertion force (ZIF) and includes a slider, a housing and a lever. The housing houses electrical contacts and includes an insertion opening to receive the flexible substrate. The slider includes a pressing plate and securing projections. The slider and lever operate to slide the slider adjacent the housing and urge the pressing plate into the insertion opening. The securing projections secure the slider and the pressing plate presses the flexible substrate against the contacts establishing stable electrical connection. The connector provides uniform contact pressure, minimizes operating space, and eliminates interference from the flexible substrate.

18 Claims, 9 Drawing Sheets

CONNECTOR FOR CONNECTING FLEXIBLE SUBSTRATES

BACKGROUND OF THE INVENTION

1. Field of the Invention

The present invention relates to a connector for connecting flexible substrates to electrical circuits. E.g., a flexible flat cable (FFC) or a flexible printed circuit substrate (FPC). More specifically, the present invention relates to a connector for connecting flexible substrates that allows a flexible substrate to be connected using low or zero insertion force.

2. Description of the Related Art

Conventionally, flexible substrate connectors serve multiple functions including electrically connecting FFCs and FPCs to each other, providing a relay connection between the two, or electrically connecting either one to a circuit substrate mounting electronic parts.

Since flexible substrates are flexible, flexible substrate connectors typically use a ZIF (zero insertion force) structure. ZIF structures allow flexible substrates to be inserted in a connector with low insertion force without exerting a contact pressure. After the flexible substrate is inserted, contact with the connector's contacts is made using a predetermined contact pressure. This contact provides a stable electrical connection.

In conventional flexible substrate connectors equipped with a ZIF structure, contact sections of multiple contacts extend into an insertion opening of a housing. A slider attaches to the insertion opening and can move forward and back. When the slider is drawn outward from the insertion opening, a space for the insertion of the flexible substrate is provided. This space allows the flexible substrate to be inserted using a low insertion force without receiving contact pressure from the contacts.

After conventional insertion, the slider is inserted into the insertion opening. The slider presses the flexible substrate toward the contact sections, resulting in adequate contact pressure with the contacts. During conventional release, the slider is withdrawn and the space around the flexible substrate allows the flexible substrate to be removed without receiving contact pressure from the contacts.

In this type of conventional connector equipped with a ZIF structure, the slider is inserted along the direction of the flexible substrate. The ZIF structure is thus difficult to use since the flexible substrate gets in the way. Further, difficulty exists since the slider is held from both sides while inserted into or removed from the insertion opening. This insertion or removal requires operating space on either side of the connector. The requirement for additional space limits printed circuit substrate density.

Referring now to FIG. 9, a conventional flexible substrate connector 100 including a ZIF structure, employs a pivotable lever 102 in place of the slider described above.

Connector 100 includes a housing 101 formed from an insulative plastic resin and mounted on a printed circuit substrate (not shown). A series of contacts 103 attached to housing 101. Lever 102 formed from an insulative plastic resin.

Contacts 103 are stamped from a conductive metal plate and each includes a contact section 103*a*, a leg 103*b* and a support 103*c*. Contact section 103*a* is positioned in a cantilevered manner to contact a conductive pattern (not shown) formed on flexible substrate 130. Leg 103*b* connects with solder to the circuit pattern on the printed circuit substrate (not shown). Support 103*c* engages lever 102.

Housing 101 includes an insertion opening 104 formed to receive flexible substrate 130. Each contact 103 is attached at a pitch corresponding to the circuit pattern formed on flexible substrate 130 so that contact section 103*a* extend into insertion opening 104.

The base end of lever 102 is bent to form a U-shaped cross-section with an inner perimeter surface formed as an arc to engage support 103*c* of contact 103, and pivot around support 103*c*. An outer perimeter surface of lever 102 is formed with a recessed surface 105*a* and a projected surface 105*b* around the rotation axis of the lever 102.

During connection, lever 102 is pivoted vertically and flexible substrate 130 is inserted into insertion opening 104 of housing 101. When flexible substrate 130 is inserted, a lowermost portion of recessed surface 105*a* of lever 102 initially extends into insertion opening 104. This action forms a space between recessed surface 105*a* and contact section 103*a* of contact 103*a* and allows flexible substrate 130 to be inserted. Flexible substrate 130 can thereby be inserted without receiving initial contact pressure from contact section 103*a*.

After flexible substrate 130 is inserted, lever 102 is pivoted to a closed position and projected surface 105*b* presses against the upper surface of flexible substrate 130. This pressing causing contact section 103*a* to flex downward and results in an elastic contact with a predetermined contact pressure between contact section 103*a* and the conductor pattern of flexible substrate 130.

During removal, lever 102 is pivoted in the opposite direction to an open position. This pivoting action forms a space in insertion opening 104 so that flexible substrate 130 can be removed without receiving contact pressure from contact section 103*a*.

With connector 100 equipped with a ZIF structure and lever 102, lever 102 can be operated without being obstructed by the now inserted flexible substrate 130. Since the insertion-removal operation is performed from above connector 100, there is no need to provide additional operating space on either side of connector 100.

However, this type of pivoting flexible substrate connector 100 uses the difference in height from the rotation axis between recessed surface 105*a* and projected surface 105*b*. This difference in height allows flexible substrate 130 to press toward contact 103, providing a predetermined contact pressure with contact section 103*a*. Forming a projected surface 105*b* to provide contact pressure with a large height difference at the base end of lever 102 is difficult. Connector 100 thereby requires either a larger size or a reduction in contact pressure since a large height difference could not be provided.

Lever 102 and flexible substrate 130 only contact along projected surface 105*b*. This minimal contact allows flexible substrate 130 to be easily pulled out with a minimal pulling force. Easy removal of flexible substrate 130 would rotate lever 102 itself, thus requiring a stopper (not shown) to prevent lever 102 from rotating as a safety backup.

Additionally, where contacts 103 are attached with a narrow pitch in housing 101, contact sections 103*a* are exposed in insertion opening 104 in a longitudinally staggered manner along the insertion direction. Since pressure on flexible substrate 130 is applied only at one position along projected surface 105*b* it is difficult to provide an elastic contact with flexible substrate 130 having uniform contact pressure. Where two different contact types (not shown) are used, uniform elastic contact pressure is very difficult.

An additional negative to this type of design is that action of projected surface 105*b* tends to wear out and distort contact section 103*a* and contacts 103 over time. A final negative to the design is that one side of flexible substrate 130 is dominated by lever 102 thereby providing a design restricting contact sections 103*a* to a single side of flexible substrate 130.

OBJECTS AND SUMMARY OF THE INVENTION

It is an object of the present invention to provide a connector for providing stable electrical connection between a flexible substrate and a circuit.

It is an object of the present invention to provide a connector for connecting flexible substrates that does not require operating space on either side of a housing.

It is another object of the present invention to provide a device that allows a lever to operate without interference from a flexible substrate.

It is another object of the present invention to provide a device that prevents a connected flexible substrate from being easily removed from a connector.

It is another object of the present invention is to provide a flexible substrate connector that allows a uniform-pressure elastic contact with a flexible substrate even where the contacts are attached to a housing in a staggered manner.

Briefly stated the present invention relates to a connector for securely and electrically connecting flexible substrates requires zero insertion force (ZIF) and includes a slider, a housing and a lever. The housing houses electrical contacts and includes an insertion opening to receive the flexible substrate. The slider includes a pressing plate and securing projections. The slider and lever operate to slide the slider adjacent the housing and urge the pressing plate into the insertion opening. The securing projections secure the slider and the pressing plate presses the flexible substrate against the contacts establishing stable electrical connection. The connector provides uniform contact pressure, minimizes operating space, and eliminates interference from the flexible substrate.

According to an embodiment of the present invention, there is provided an electrical connector for connecting a pattern of conductors in a flexible flat cable to a circuit comprising: a housing, the housing including a slot for receiving an end of the flexible flat cable, a plurality of contacts in the housing alignable with the pattern of conductors when the end is inserted into the slot, a slider having a pressing plate thereon, the pressing plate being insertable into the slot adjacent the flexible flat cable, and at least one of the housing and the pressing plate having a shape which urges the pressing plate into firm contact with a surface of the flexible cable as the pressing plate is inserted, whereby the pattern of conductors is urged into stable electrical contact with the plurality of connectors and the housing provides a minimum profile.

According to another embodiment of the present invention there is provided an electrical connector, further comprising: a first and a second guide frame on the housing, a first arm and a second arm on the slider, and the first arm and the second arm slidably engaging each respective the first and the second guide frame, whereby the housing guides the slider into uniform close contact.

According to another embodiment of the present invention there is provided an electrical connector, further comprising: a lever, a first and a second pivot arm on the lever, a first shaft extending from each the first and the second pivot arm, each the first shaft rotatably joining the lever to the housing, whereby the lever is operable relative to the housing and provides a narrow profile to the electrical connector, and the lever at a first side of the housing after the pressing plate is inserted whereby the lever provides protection to the plurality of contacts.

According to another embodiment of the present invention there is provided an electrical connector, further comprising: an open position and a closed position on the slider, and the lever engagable with the slider and operating the slider between the open position and the closed position, whereby the lever urges the slider into uniform close contact with the housing as the pressing plate is inserted in the slot.

According to another embodiment of the present invention there is provided an electrical connector, further comprising: a front cam surface on each the first and the second pivot arm, a rear cam surface on each the first and the second pivot arm, a front follower surface on the first and the second arm of the slider, a rear follower surface on the first and the second arm of the slider, each the front cam surface engagable with each the front follower surface during an opening action of the slider, and each the rear cam surface engagable with the rear follower surface during a closing action of the slider to urge the slider into the uniform close contact.

According to an embodiment of the present invention there is provided an electrical connector for connecting a pattern of conductors in a flexible substrate to a circuit comprising: a housing, a plurality of contacts in the housing for electrical connection to the circuit, the housing including means for receiving the flexible substrate in a clearance position in the housing, the means for receiving including means for aligning the pattern of conductors with the plurality of contacts when an end of the flexible substrate is received into the housing, means for engaging the flexible substrate to force the pattern of conductors into firm electrical connection with the plurality of contacts, and at least one of the housing and the means for engaging having a shape which urges the pattern of conductors into secure electrical connection with the plurality of contacts in a direction perpendicular to an insertion direction whereby the electrical connector minimizes operating space, eliminates interference from the flexible substrate and provides uniform contact pressure.

According to another embodiment of the present invention there is provided an electrical connector, further comprising: a slider in the means for engaging, the slider slidably engaging the housing, a pressing plate on the slider slidably insertable in the means for receiving, and the pressing plate resiliently urging the pattern of conductors into secure electrical connection with the plurality of contacts.

According to another embodiment of the present invention there is provided an electrical connector, further comprising: means for operating the slider between a projected position and a recessed position, the means for operating providing a uniform insertion force along a width direction of the flexible substrate during engagement.

According to another embodiment of the present invention there is provided an electrical connector, further comprising: a lever in the means for operating, the lever engaging the slider to operate the slider between the projected position and the recessed position, and the lever receiving a closing force and magnifying the closing force applied to the slider thereby maximizing the urging and permitting the electrical connection to the circuit with a minimum effort.

According to an embodiment of the present invention there is provided an electrical connector for connecting a patter of conductors in a flexible substrate to a circuit, comprising: a housing, the housing including a slot for receiving an end of the flexible substrate, a plurality of contacts in the housing alignable with the pattern of conductors when the end is inserted into the slot, a slider having a pressing plate thereon, the pressing plate being insertable into the slot adjacent the flexible substrate, at least one of the housing and the pressing plate having a shape which urges the pressing plate into firm contact with a surface of the flexible substrate as the pressing plate is inserted whereby the pattern of conductors is urged into stable electrical connection with the plurality of contacts, means for operating the slider between a projected position and a recessed position, the means for operating providing a uniform insertion force along a width direction of the flexible substrate during insertion, a lever in the means for operating, the lever engaging the slider to operate the slider between the projected position and the recessed position, and the lever magnifying a closing force applied to the slider thereby maximizing the urging and permits the electrical connection to the circuit with a minimum effort.

According to an embodiment of the present invention there is provided a flexible substrate connector for connecting a pattern of conductors in a flexible substrate to a circuit, comprising: a housing, a plurality of contacts in the housing for electrically connecting the circuit, an insertion slot in the housing for receiving an end of the flexible substrate, the plurality of contacts alignable with the pattern of conductors when the end is inserted into the slot, a slider slidably engaging the housing, a pressing plate on the slider slidably insertable in the housing through the insertion slot adjacent the flexible substrate, a lever rotatably engaging the housing, the lever camably engaging the slider to operate the slider between an inserted position and a closed position whereby the lever provides a uniform engaging force along a width direction of the slider during insertion and the flexible connector minimizes operating space, and at least one of the housing, the pressing plate, and the plurality of contacts having a shape which urges the pressing plate into firm contact with a surface of the flexible substrate as the pressing plate is inserted whereby the pattern of conductors is urged into stable electrical contact with the plurality of contacts.

According to another embodiment of the present invention there is provided a flexible substrate connector, further comprising: the plurality of position slits having a pitch corresponding to a pitch of the pattern of conductors, a contact section and an attachment section on each the contact, the contact sections having a shape enabling elastic engagement with the pattern of conductors, the plurality of contacts arrayed along a width direction of the housing in at least a first row, a plurality of position slits in the housing adjacent the insertion slot, and each the attachment section engagable with each the position slit whereby the plurality of contacts is firmly retained in the housing in positions corresponding to the pattern of conductors.

According to another embodiment of the present invention there is provided a flexible substrate connector, further comprising: a first arm and a second arm on the slider, a first and a second guide frame on the housing, and the first and the second guide frame slidably guiding the first and the second arm of the slider during insertion whereby the slider maintains an aligned relation between the pressing plate, the slider, and the housing.

According to another embodiment of the present invention there is provided a flexible substrate connector, further comprising: a first securing projection on each the first arm and the second arm, a first securing slit on each the first and the second guide frame, and each the first securing projection slidably retained within each the first securing slit during operation whereby the slider is prevented from separating from the housing and the flexible substrate connector has a minimum size.

According to another embodiment of the present invention there is provided a flexible substrate connector, further comprising: a first and a second pivot arm on the lever, a bounded hole in the housing opposite each the first and the second pivot arm, a pivot shaft on each the first and the second pivot arm engaging the bounded hole and rotatably connecting the lever to the housing, a front cam surface on each the first and the second pivot arm, a rear cam surface on each the first and the second pivot arm, a front follower surface on each the first and the second arm, a rear follower surface on each the first and the second arm, each the front cam surface engaging each the front follower surface during the insertion and driving the slide to the inserted position, and each the rear cam surface engaging each the rear follower surface during an opening operation of the slider, whereby the lever cam-ably engages the slider and operates the slider between the inserted position and the closed position and provides the uniform engaging force along a width direction of the slider in a minimum of space.

According to another embodiment of the present invention there is provided a flexible substrate connector, wherein: each the first and the second guide frame extend from opposite sides of the housing to an end adjacent the plurality of contacts whereby the plurality of contacts is protected from lateral damage during use and attachment to the circuit, and the lever at the closed position of the slider extending above the end of the plurality of contacts whereby the plurality of contacts is protected from vertical damage during use and attachment to the circuit.

According to another embodiment of the present invention there is provided a flexible substrate connector, wherein: the plurality of contacts is arrayed in at least the first and a second row along the width direction of the housing.

According to an embodiment of the present invention there is provided a flexible substrate connector, comprising: a housing containing a plurality of electrically conductive contacts for electrically connecting to a printed circuit substrate, the plurality of contacts elastically deformable in a direction perpendicular to an insertion direction, the housing including an insertion slot formed for receiving a flexible substrate with a conductor pattern adjacent the plurality of contacts, a slider slidably engagable with the housing, the slider including a pressing plate member for slidably inserting in the housing, lever means for urging the pressing plate member into the housing, the pressing plate member pressing the plurality of contacts against the conductor pattern to secure firm electrical connection to the printed circuit substrate, the pressing plate member providing resilient urging to the flexible substrate in a direction perpendicular to the insertion direction, and the plurality of contacts electrically connecting the flexible substrate to the printed circuit substrate whereby the flexible substrate is firmly retained in the housing with zero insertion force and is securely and elastically retained in the housing to ensure stable electrical contact.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
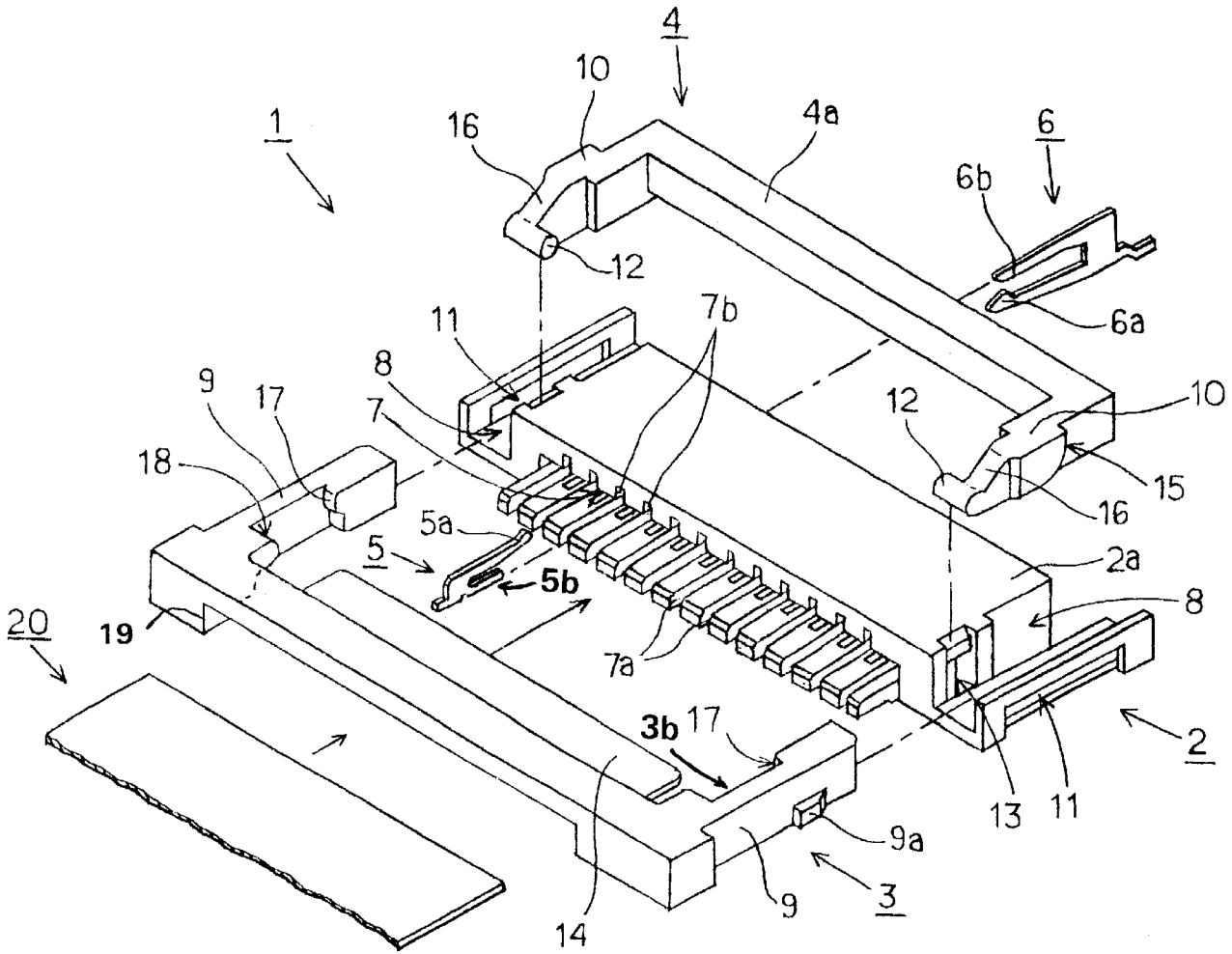
FIG. 1 is an exploded perspective view of a flexible substrate connector.

Referring now to FIG. 1, a connector 1, being a flexible substrate connector, includes a housing 2, a slider 3 a lever 4, and multiple contacts 5, 6, as will be explained.

Housing 2 includes a main unit 2*a* molded from an insulative plastic resin. Main unit 2*a* forms a wide, rectangular box shape and retains contacts 5, 6, as will be explained. Contacts 5, 6 are secured within main unit 2*a*.

An insertion opening 7 is formed along one side of main unit 2*a* as a lateral slit. Insertion opening 7 is formed to receive a flexible substrate 20, as will be explained. Insertion opening 7 includes positioning slits 7*a*, 7*b* formed on inner walls above and below insertion opening 7. Position slits 7*a*, 7*b* position contacts 5, 6.

Position slits 7*a*, 7*b* are positioned and aligned with conductor patterns (not shown) on flexible substrate 20. Slits 7*a* open to a front side of housing 2 and position contacts 5. Slits 7*b* are also open to the front side and position contacts 6. Each contact 5, 6 includes a contact section 5*a*, 6*a*. Contact sections 5*a*, 6*a* are exposed along a bottom surface of insertion opening 7 and form two operable rows.

A pair of guide frames 8, 8 extend longitudinally along either side of main unit 2*a*. Guide frames 8, 8 open upwardly toward a top surface of main unit 2*a*.

A pair of arms 9, 9 extend from slider 3. Arms 9, 9 are slidable within respective guide frames 8, 8. Guide frames 8, 8 have a shape that holds slide arms 9, 9 so that slide arms 9, 9 can slide back and forth along main unit 2*a*.

A pair of pivot arms 10, 10 are on lever 4. Guide frames 8, 8 rotatively hold pivot arms 10, 10 during operation of lever 4, as will be explained.

A pair of securing projections 9*a* on arms 9 of slider 3 loosely fit and slide in slits 11. Securing projections 9*a* prevent slider 3 from slipping out of slits 11, after installation, as will be explained. A slider opening 19 on a face of slider 3, provides access to insertion opening 7, as will be explained.

A pair of projection holes 13, 13 are on a rear of each guide frame 8, 8. A pair of shafts 12, 12 extend inward from each pivot arm 10, 10. Shafts 12, 12 are loosely retained in projection holes 13, 13 and pivotably support lever 4.

Slider 3 is molded from an insulative plastic resin. Slide arms 9, 9 project forward from either side of slider 3 and are shaped as horizontal rod. Slider 3 covers the front side of housing 2. A pressing plate 14, having a generally rectangular shape projects toward housing 2 between slide arms 9, 9.

Securing projections 9*a*, 9*a* are integrally formed on an outside surface of slide arms 9. Cavities 3*b*, 3*b* are formed on the inside of arms 9, 9. Cavities 3*b*, 3*b* are formed to receive respective pivot arms 10, 10 of pivoting lever 4. Lever 4 includes cam surfaces 15, 16 on each pivot arm 10, 10. The upper parts of opposing frontward and rearward inner walls of cavities 3*b*, 3*b* are formed as projecting curved surfaces that abut each respective cam surfaces 15, 16. The frontward wall surface of each cavity 3*b*, 3*b* is a front follower surface 17. The rearward wall surface of each cavity 3*b*, 3*b* is a rear follower surface 18.

Pressing plate 14 can be inserted in insertion opening 7 and operates to press flexible substrate 20 toward contact sections 5*a*, 6*a* of respective contacts 5, 6. It is to be understood that a contact pressure or 'flexion' of contacts 5, 6 can be adjusted by adjusting the thickness of pressing plate 14. It is to be additionally understood that the contact pressure or 'flexion' of contacts 5, 6 may be additionally adjusted through alternative material selection for contacts 5, 6 or through changing a thickness of contact sections 5*a*, 6*a*.

It is to be understood that during insertion of pressing plate 14 in opening 7, guide frames 8, 8 longitudinally guide respective slide arms 9, 9. As a result, the slider 3 is able to move forward and back between a recessed position, where pressing plate 14 is drawn out from the insertion opening 7, and a projected position, where pressing plate 14 is inserted into the insertion opening 7.

It is to be understood that main unit 2*a* provides a clearance position along insertion opening 7 to slidably and guidably receive flexible substrate 20 and prevent an end of flexible substrate 20 from inappropriately curling or blocking complete insertion.

Lever 4 is molded from an insulative plastic resin in a "C-type" shape. An operating section 4*a*, shaped as a horizontal rod operably connects pivot arms 10, 10. A gently rising sloped surface extends continuously from each shaft 12, 12 along pivot arms 10, 10. This sloped surface forms rear cam surface 16 that abuts rear follower surface 18 during operation.

An outer surface of pivot arms 10, 10 projects outward at a center. The outer surface formed from the base side to the top side of arms 10, 10 is an arced surface. This arced surface is front cam surface 15, 15. During operation, each front cam surface 15, abuts respective front follower surface 17.

Lever 4 freely pivots in holes 13, 13 around shafts 12, 12. During assembly, when is attached to housing 2, each pivot arm 10 is inserted through each cavity 3*b*, of slider 3 so that each front cam surface 15 and each rear cam surface 16 face respective front follower surface 17 and rear follower surface 18.

Contacts 5, 6 are formed by stamping an elastic conductive metal plate, typically a copper alloy, in the shape of a two-pronged fork. It is to be understood 5 that contacts 5, 6 maybe formed from any elastic electrically conductive medium and do not require a copper alloy to function.

An upper prong of contact 5 forms contact section 5*a* and a lower prong forms the an attachment section 5*b*. During assembly, attachment section 5*b* is pressed into position slit 7*a* of housing 2. After assembly, attachment section 5*b* is secured in slit 7*a* and is secured to housing 2. An end of cantilevered contact section 5*a* projects forward from the bottom surface of insertion opening 7.

A lower prong of contact 6 forms contact section 6*a* and the upper prong forms an attachment section 6*b*. During assembly, attachment section 6*b* is pressed into slit 7*b* of housing 2. After assembly, attachment section 6*b* is secured to housing 2 and an end of cantilevered contact section 6*a* projects forward from the bottom surface of insertion opening 7.

A base of the respective prongs of contacts 5, 6 are exposed in parallel along a bottom surface of housing 2. The base of contacts 5, 6 are soldered to land patterns (not shown) disposed at positions facing the printed circuit substrate (not shown) on which connector 1 is mounted.

Figure 2A:
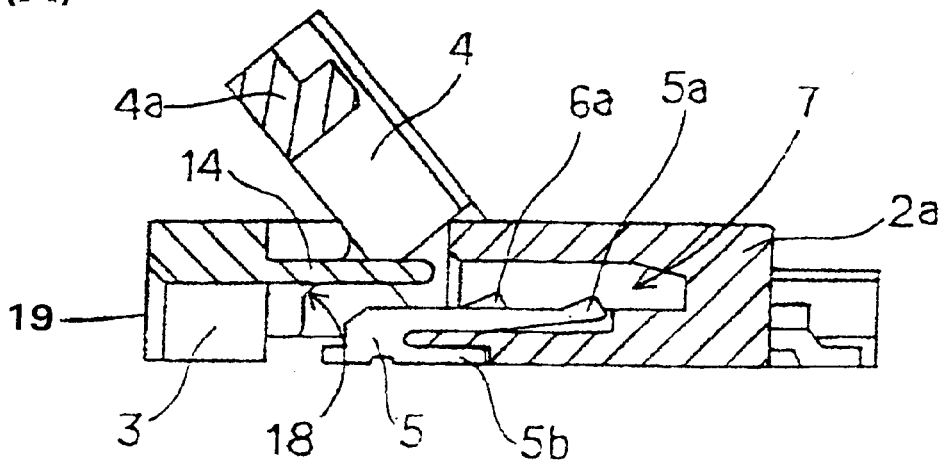
FIG. 2(A) is sectional view of a flexible substrate connector in a ready state.
Figure 2B:
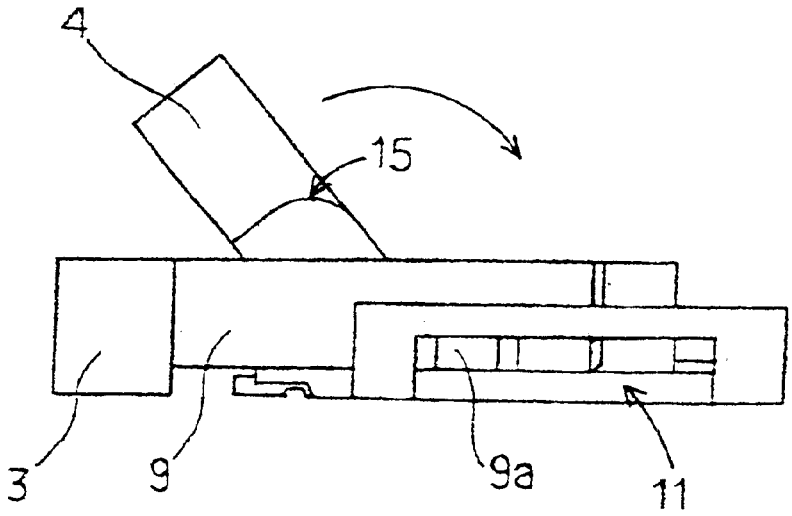
FIG. 2(B) is a side view of a flexible substrate connector.

Additionally referring now to FIGS. 2(A) and 2(B), operating section 4*a* of lever 4 is in a ready state and slider 3 with pressing plate 14 is positioned for insertion into insertion opening 7. During assembly, lever 4 is rotated in the direction of the arrow thereby urging slider 3 along slits 11.

Figure 3A:
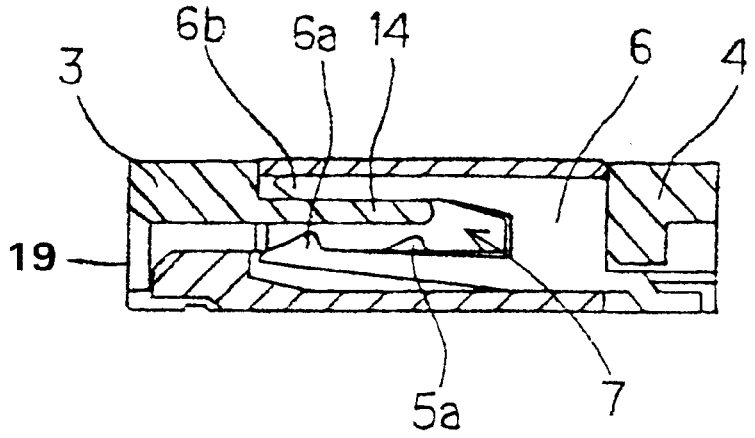
FIG. 3(A) is sectional view of a flexible substrate connector in a connected state.
Figure 3B:
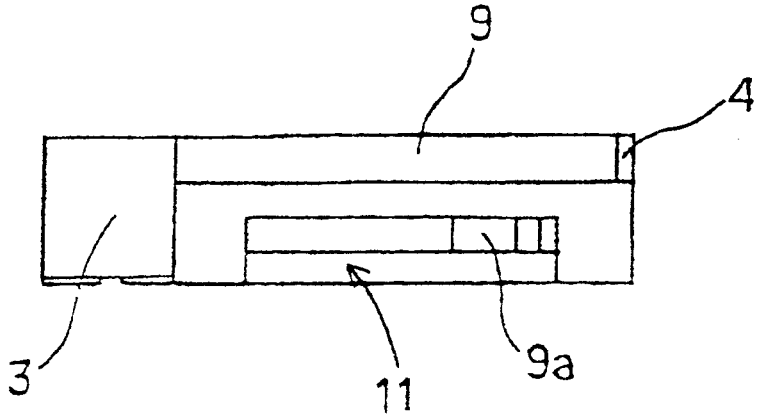
FIG. 3(B) is a side view of a flexible substrate connector.

Additionally referring now to FIGS. 3(A) and 3(B) lever 4 is in a connected state and pressing plate 14 is positioned between contacts 5, 6 above contact sections 5*a*, 6*a*.

Figure 4:
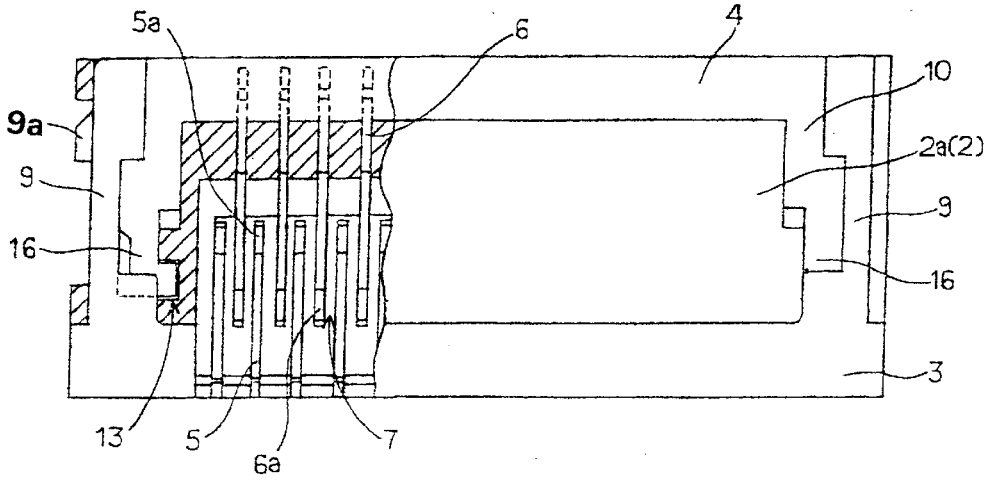
FIG. 4 is a partially cut away plan view of a flexible substrate connector.
Figure 5:
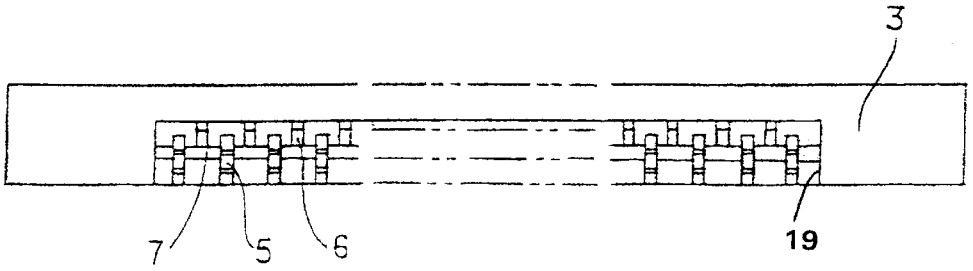
FIG. 5 is a front-view drawing of a flexible substrate connector.

Additionally referring now to FIGS. 4 and 5, multiple contacts 5, 6 are arranged parallel to each other with a uniform pitch along the width of main unit 2*a*. Contacts 5, 6 form a staggered pattern from the rear to the front of main unit 2*a*. This staggered pattern allows connectors 5, 6 to be both electrically connected to conductor patterns on flexible substrate 20 which have a narrow pitch, and to densely printed land patterns on a printed circuit substrate. It is to be understood, that designs allowing reliable dense electrical connection are desirably for miniaturization and efficiency reasons. It is to be additionally understood that a uniform pitch for contacts 5, 6 is not required only that contacts 5, 6 are positioned to secure electrical connection between flexible substrate 20 and the printed circuit substrate (not shown).

Figure 6A:
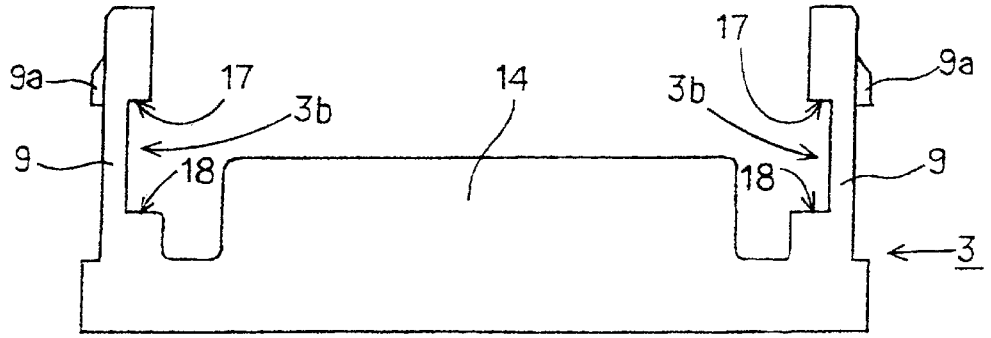
FIG. 6(A) is a plan view of a slider.
Figure 6B:
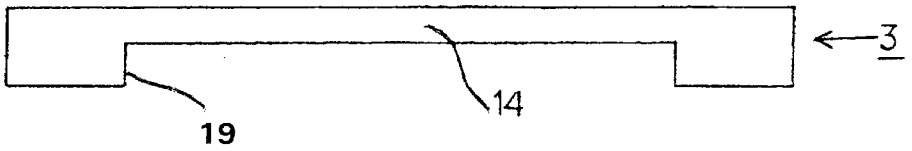
FIG. 6(B) is a front-view of a slider.
Figure 6C:
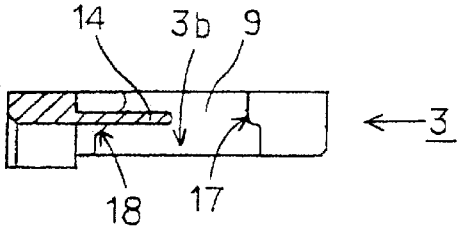
FIG. 6(C) is a vertical cross-section view of a slider.
Figure 7A:
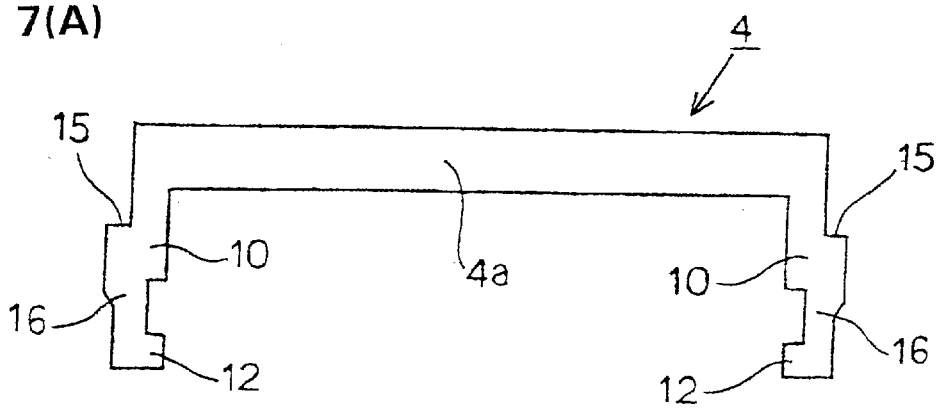
FIG. 7(A) is a plain view of a lever.
Figure 7B:
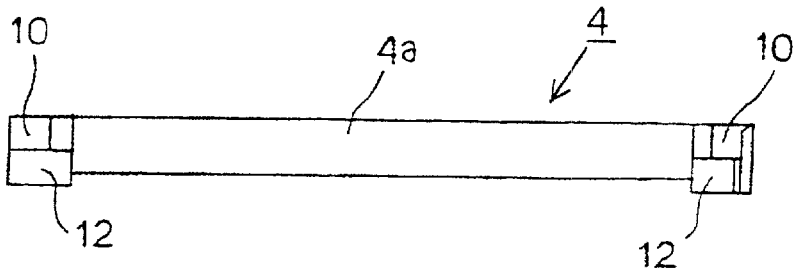
FIG. 7(B) is a front-view of a lever.
Figure 7C:
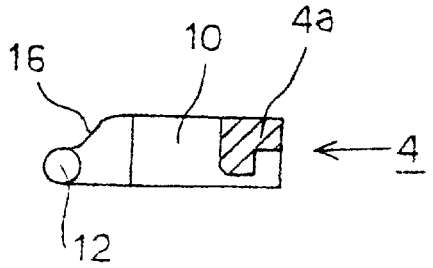
FIG. 7(C) is a vertical cross-section view of a lever.
Figure 7D:
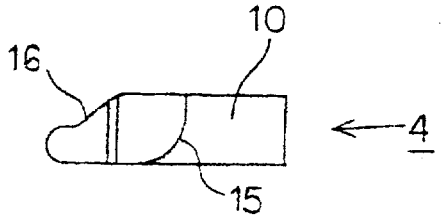
FIG. 7(D) is a side-view of a lever.
Figure 8A:
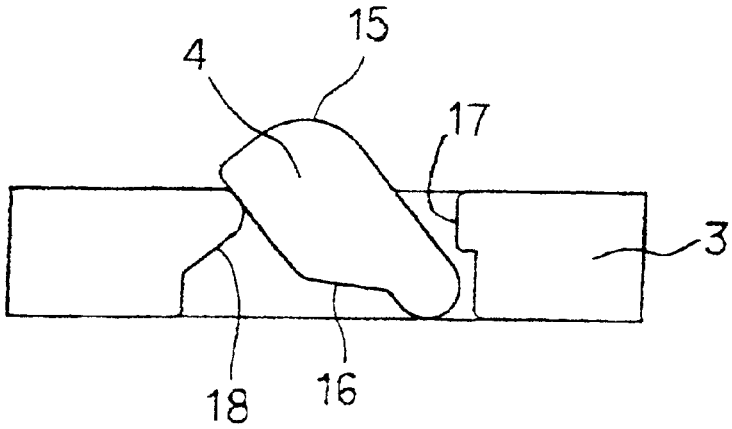
FIG. 8(A) is a descriptive view of the tandem action of a lever and a slider.
Figure 8B:
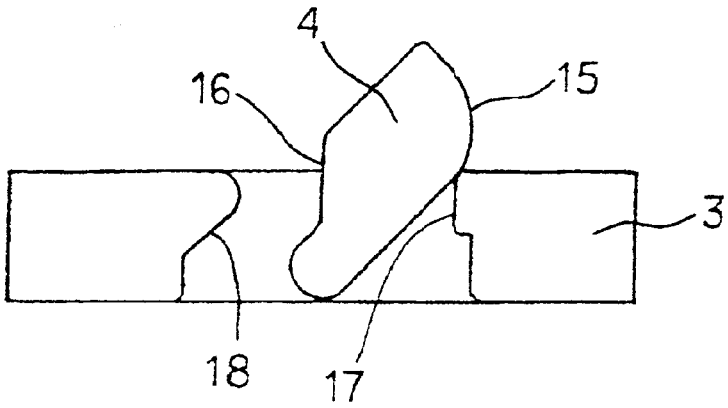
FIG. 8(B) is a descriptive view of the tandem action of a lever and a slider.
Figure 8C:
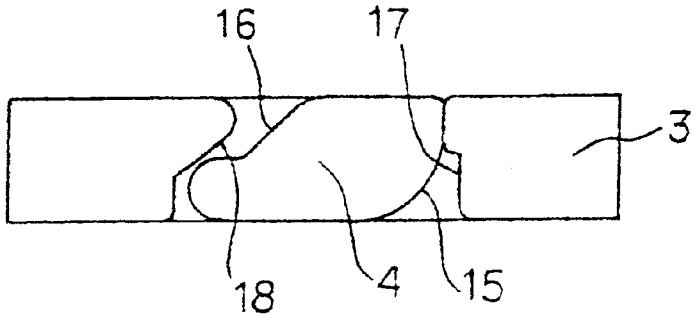
FIG. 8(C) is a descriptive view of the tandem action of a lever and a slider.
Figure 8D:
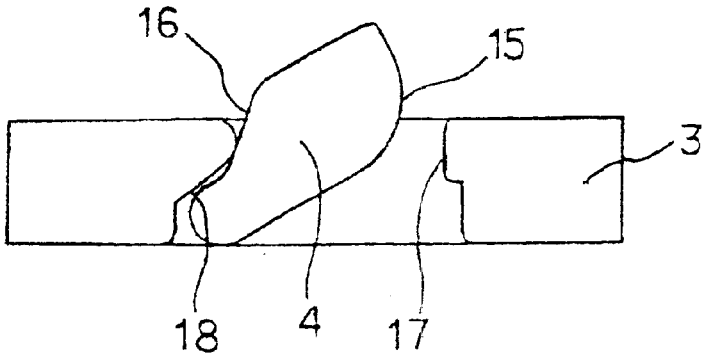
FIG. 8(D) is a descriptive view of the tandem action of a lever and a slider.
Figure 8E:
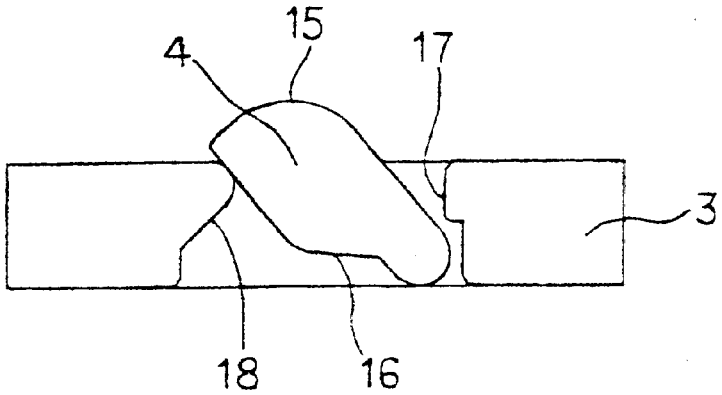
FIG. 8(E) is a descriptive view of the tandem action of a lever and a slider.
Figure 9:
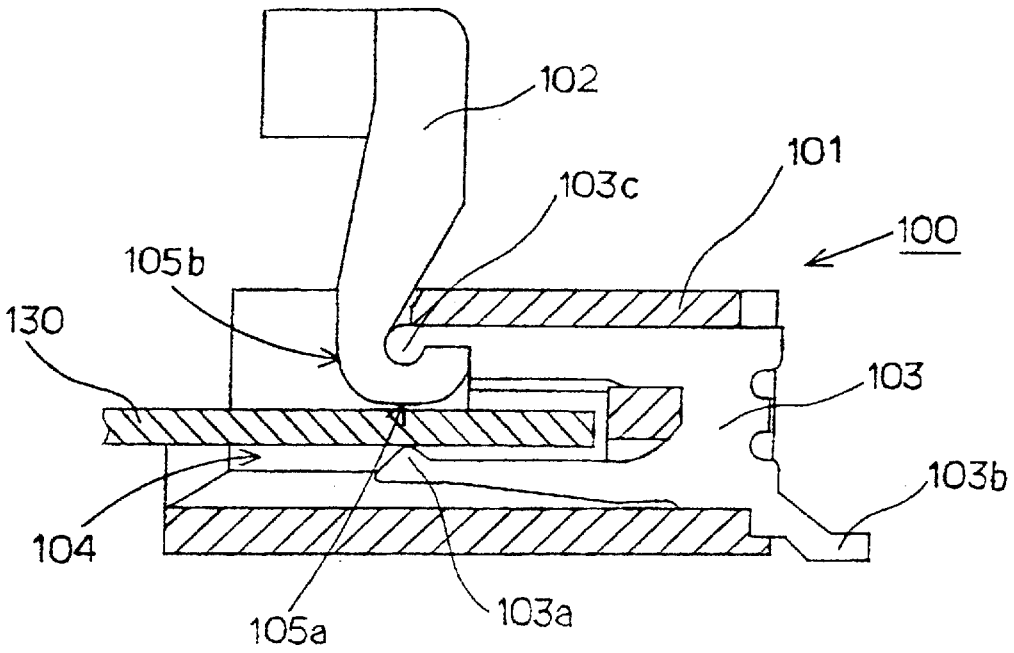
Fig. 9 Prior Art
FIG. 9 is a vertical cross-section view of a conventional flexible substrate connector.

Additionally referring now to FIGS. 6(A), 6(B), and 6(C), slider 3 includes arms 9. Each arm 9 includes cavities 3*b* on an inside portion. Each cavity 3*b* is bounded by front follower surface 17 and rear follower surface 18.

Additionally referring now to FIGS. 7(A) through 7(D), each lever 4 includes pivot arms 10, 10. Each pivot arm 10 includes cam surfaces 15, 16 extending from shaft 12 along a respective lower and upper surface of pivot arm 10.

Additionally referring now to FIGS. 8(A) through 8(E), during insertion, lever 4 is pivoted rearward relative to housing 2 before inserting flexible substrate 20 through slider opening 19. This pivoting action causes rear cam surface 16 of lever 4 to abut rear follower surface 18 of slider 3, resulting in slider 3 sliding away from housing 2.

During the pivoting action, an angle between lever 4 and housing 2 increases until securing projections 9*a* of slider 3 abut the rear ends of slots 11, thus stopping the sliding action. At this recessed position, where slider 3 is fully extended, pressing plate 14 is drawn out from insertion opening 7 creating a ready state.

In the ready state, since pressing plate 14 is not in insertion opening 7, a space exists between contact sections 5*a*, 6*a* of respective contacts 5, 6 and the inner wall surfaces of insertion opening 7. This space is wider than the thickness of flexible substrate 20. As a result, flexible substrate 20 is readily insertable into insertion opening 7 without receiving contact pressure from contacts 5, 6.

During assembly, after flexible substrate 20 is inserted, lever 4 is pivoted forward around shafts 12. During pivoting, front cam surface 15 of lever 4 abuts front follower surface 17 of slider 3, urging slider 3 and pressing plate 14 forward and into main unit 2*a*.

When lever 4 is filly pivoted until parallel with slider 3, slider 3 stops at a projected position where pressing plate 14 is fully inserted into insertion opening 7 and urging flexible substrate 20 against contacts 5, 6, thereby crating a connected state.

Approaching the connected state, pressing plate 14 is urged into the space in insertion opening 7 and pushes flexible substrate 20 toward contact sections 5*a*, 6*a* of contacts 5, 6, causing contact sections 5*a*, 6*a* to elastically flex downward. Since contacts 5, 6 are elastic, an elastic contact is formed at a predetermined contact pressure with the conductor patterns of flexible substrate 20. This elastic contact is to be understood to provide a good electrical contact with flexible substrate 20.

In the connected state, pressing plate 14 is pressed tightly against the upper surface of flexible substrate 20, thus preventing flexible substrate 20 from being accidentally removed even under substantial force. Further, slider 3 abuts front cam surface 15 of the lever 4, thus restricting rearward sliding and preventing slider 3 from accidentally slipping out away from main unit 2*a*. It is to be understood that these combined actions provide a secure and elastic connection with good electrical contact to contacts 5, 6.

It is to be further understood that the thickness and flexibility of pressing plate 14 are selectable according to the requirements flexible substrate 20, contacts 5, 6 and other factors sufficient to achieve the goal stated above.

It is to be further understood that insertion opening 7 has a shape and size that allows a front end of flexible substrate 20 to be non-uniform, thus allowing easy insertion and rapid connection under non-ideal conditions. Since insertion opening 7 extends beyond contact section 5*a*, additional space is provided for non-ideal conditions and non-ideal insertion thereby allowing easy operation and secure connection under field conditions.

During disengagement, lever 4 is pivoted rearward and slider 3 slides rearward to the recessed position, thus brining connector 1 back to its ready state. As a result, pressing plate 14 is drawn out and the same operations described above allow flexible substrate 20 to be pulled out with a very low removal force. This low removal force allows easy inspection and re-attachment.

The embodiment described above uses a cam-type mechanism in which front and rear cam surfaces 15, 16 are formed on lever 4 and slider 3 moves in tandem with lever 4 by using respective front and rear follower surfaces 17, 18.

It is to be understood that other joining-type mechanisms, e.g., linking mechanisms, can be used instead of surfaces 15, 16, 17, and 18, as long as the rotation of lever 4 can be converted to linear reciprocating motion of slider 3. It is to be further understood, that the cam-type mechanism described in the embodiment above may be adapted to other types of cam mechanisms such as a solid cam formed from a groove cam, and a pin that engages with the groove gam.

Further, since flexible substrate 20 is pushed by slider 3 toward contacts 5, 6, it should also be understood that pressing plate 14 may be inserted in housing 2 before insertion so that contacts 5, 6 are pressed toward flexible substrate 20 without first sliding forward. It should be further understood, that an another embodiment of pressing plate 14 and housing 2, may allow pressing plate 14 to push contacts 5, 6, into electrical contact with flexible substrate 20 and not the reverse, as in the present embodiment.

Further, it should be understood that one or more sets of additional contacts maybe employed and positioned to electrically connect flexible substrate 20 with a circuit board (not shown).

An important benefit of the present embodiment is that a ZIF mechanism, with a pivoting lever is embodied so that lever 4 can be rotated without obstructing inserted flexible substrate 20. This provides the added benefit of reducing the need for operating space around connector 1.

Another benefit is that guides 8, on either side of main unit 2*a* extend beyond main unit 2*a* and protect an external portion of contact 6. This design minimizes external damage during assembly, handling and use while allowing ready attachment to a circuit board (not shown) thereby speeding installation.

A further benefit is that adequate contact pressure between contacts 5, 6 and flexible substrate 20 can be adjusted by adjusting the thickness of inserted slider 14. This adjustment is easily accomplished by the ready replaceability of different sliders 3. Since slider 3 is easily removable from guides 8, replacement is simple and fast.

An additional benefit is that pulling force on flexible substrate 20 does not directly transfer to lever 4. Slider 3 with pressing plate 14 resists any pulling force without transmission to lever 4. This resistance prevents lever 4 from being accidentally pivoted and allows contact to be maintained reliably.

Furthermore, in a connected state, slider 3 is pressed tightly parallel against flexible substrate 20, providing even pressure on flexible substrate 20 over a wide contact area. This even pressure prevents flexible substrate 20 from being easily pulled out and from damage at stress concentrations. Pressing plate 14 provides further uniform pressure across contacts 5, 6 further minimizing stress concentrations and damage.

Addition embodiments are readily adapted to have contact sections 5*a*, 6*a* of contacts 5, 6 placed additionally above flexible substrate 20 so that flexible substrate 20 can be pushed from below toward contacts 5, 6 positioned above.

It is to be understood that the mechanism of lever 4 and slider 3 operate in tandem to secure flexible substrate 20 thereby providing a secure and speed contact. Further, since lever 4 acts using multiple cam surfaces, pressing force is lowered and easily and uniformly applied across the face of flexible substrate 20.

It is to be understood that when closed, lever 4 and the extensions of guide grooves 8, 8 provide protection for the portion of contacts 6 exposed on a back side of main unit 2*a*. This protection minimizes electrical shorting from poor soldering, damage from unplanned physical contact, and facilitates handling of a completed circuit.

Since the multiple cam surfaces are close to the rotation axis of shafts 12, 12 during pivoting leverage will allow slider 3 to operate with less operator force, thereby minimizing damage to surrounding equipment.

According to the embodiment described, pressing plate 14 acts on contact sections 5*a*, 6*a* in the same manner even if they are exposed at different longitudinal positions in insertion opening 7. Thus, elastic contact with flexible substrate 20 can be provided with uniform contact pressure.

It is to be understood that contact pressure can be adjusted for individual contacts by changing the thickness of a particular position or section on pressing plate 14 at a position where it abuts a particular contact section 5*a*, 6*a*.

It is to be understood that the shape of either or both of pressing plate 14, contacts 5, 6, and housing 2 can be selected to provide stable electrical connection to flexible substrate 20.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described or suggested herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. An electrical connector for connecting a pattern of conductors in a flexible flat cable to a circuit comprising:

a housing;

said housing including a slot for receiving an end of said flexible flat cable;

a plurality of contacts in said housing alignable with said pattern of conductors when said end is inserted into said slot;

a slider having a pressing plate thereon;

means for operating said slider between a projected position and a recessed position, said slider moving longitudinally with respect to said housing;

said pressing plate being insertable into said slot adjacent said flexible flat cable; and at least one of said housing and said pressing plate having a shape which urges said pressing plate into uniform, firm contact with a surface of said flexible cable as said pressing plate is inserted, whereby said pattern of conductors is urged into stable electrical contact with said plurality of contacts and said housing provides a minimum profile.

2. An electrical connector, according to claim 1, further comprising:

a first and a second guide frame on said housing;

a first arm and a second arm on said slider; and said first arm and said second arm slidably engaging each respective said first and said second guide frame, whereby said housing guides said slider into uniform close contact.

3. An electrical connector, according to claim 2, further comprising:

a lever;

a first and a second pivot arm on said lever;

a first shaft extending from each said first and said second pivot arm;

each said first shaft rotatably joining said lever to said housing, whereby said lever is operable relative to said housing and provides a narrow profile to said electrical connector; and said lever at a first side of said housing after said pressing plate is inserted whereby said lever provides protection to said plurality of contacts.

4. An electrical connector for connecting a pattern of conductors in a flexible flat cable to a circuit comprising:

a housing;

said housing including a slot for receiving an end of said flexible flat cable;

a plurality of contacts in said housing alignable with said pattern of conductors when said end is inserted into said slot;

a slider having a pressing plate thereon;

said pressing plate being insertable into said slot adjacent said flexible flat cable;

at least one of said housing and said pressing plate having a shape which urges said pressing plate into firm contact with a surface of said flexible cable as said pressing plate is inserted, whereby said pattern of conductors is urged into stable electrical contact with said plurality of contacts and said housing provides a minimum profile;

a first and a second guide frame on said housing;

a first arm and a second arm on said slider;

said first arm and said second arm slidably engaging each respective said first and said second guide frame, whereby said housing guides said slider into uniform close contact;

a lever;

an open position and a closed position on said slider; and said lever engagable with said slider and operating said slider between said open position and said closed position, whereby said lever urges said slider into uniform close contact with said housing as said pressing plate is inserted in said slot.

5. An electrical connector, according to claim 4, further comprising:

a front cam surface on each said first and said second pivot arm;

a rear cam surface on each said first and said second pivot arm;

a front follower surface on said first and said second arm of said slider;

a rear follower surface on said first and said second arm of said slider;

each said rear cam surface engagable with each said rear follower surface during an opening action of said slider; and each said front cam surface engagable with each said front follower surface during a closing action of said slider to urge said slider into said uniform close contact.

6. An electrical connector for connecting a pattern of conductors in a flexible substrate to a circuit comprising:

a housing;

a plurality of contacts in said housing for electrical connection to said circuit;

said housing including means for receiving said flexible substrate in a clearance position in said housing;

said means for receiving including means for aligning said pattern of conductors with said plurality of contacts when an end of said flexible substrate is received into said housing;

means for engaging said flexible substrate to force said pattern of conductors into firm electrical connection with said plurality of contacts;

said means for engaging said flexible substrate moving longitudinally with respect to said housing, said means for engaging said flexible substrate providing uniform contact with a surface of said flexible substrate; and at least one of said housing and said means for engaging having a shape which urges said pattern of conductors into secure electrical connection with said plurality of contacts in a direction perpendicular to an insertion direction, whereby said electrical connector minimizes required operating space, eliminates interference from said flexible substrate and provides uniform contact pressure.

7. An electrical connector, according to claim 6, further comprising:

a slider in said means for engaging;

said slider slidably engaging said housing;

a pressing plate on said slider slidably insertable in said means for receiving; and said pressing plate resiliently urging said pattern of conductors into secure electrical connection with said plurality of contacts.

8. An electrical connector, according to claim 7, further comprising:

means for operating said slider between a projected position and a recessed position;

said means for operating providing a uniform insertion force along a width direction of said flexible substrate during engagement.

9. An electrical connector for connecting a pattern of conductors in a flexible flat cable to a circuit comprising:

a housing;

a plurality of contacts in said housing for electrical connection to said circuit;

said housing including means for receiving said flexible substrate in a clearance position in said housing;

said means for receiving including means for aligning said pattern of conductors with said plurality of contacts when an end of said flexible substrate is received into said housing;

means for engaging said flexible substrate to force said pattern of conductors into firm electrical connection with said plurality of contacts;

at least one of said housing and said means for engaging having a shape which urges said pattern of conductors into secure electrical connection with said plurality of contacts in a direction perpendicular to an insertion direction, whereby said electrical connector minimizes required operating space, eliminates interference from said flexible substrate and provides uniform contact pressure;

a slider in said means for engaging;

said slider slidably engaging said housing;

a pressing plate on said slider slidably insertable in said means for receiving;

said pressing plate resiliently urging said pattern of conductors into secure electrical connection with said plurality of contacts means for operating said slider between a projected position and a recessed position;

said means for operating providing a uniform insertion force along a width direction of said flexible substrate during engagement;

a lever in said means for operating;

said lever engaging said slider to operate said slider between said projected position and said recessed position; and said lever receiving a closing force and magnifying said closing force applied to said slider thereby maximizing said urging and permitting said electrical connection to said circuit with a minimum effort.

10. An electrical connector for connecting a pattern of conductors in a flexible substrate to a circuit, comprising:

a housing;

said housing including a slot for receiving an end of said flexible substrate;

a plurality of contacts in said housing alignable with said pattern of conductors when said end is inserted into said slot;

a slider having a pressing plate thereon; said pressing plate being insertable into said slot adjacent said flexible substrate;

at least one of said housing and said pressing plate having a shape which urges said pressing plate into firm contact with a surface of said flexible substrate as said pressing plate is inserted whereby said pattern of conductors is urged into stable electrical connection with said plurality of contacts;

means for operating said slider between a projected position and a recessed position;

said means for operating providing a uniform insertion force along a width direction of said flexible substrate during insertion;

a lever in said means for operating;

said lever engaging said slider to operate said slider between said projected position and said recessed position; and said lever magnifying a closing force applied to said slider, thereby maximizing said urging and permitting said electrical connection to said circuit with a minimum effort.

11. A flexible substrate connector for connecting a pattern of conductors in a flexible substrate to a circuit, comprising:

a housing;

a plurality of contacts in said housing for electrically connecting said circuit;

an insertion slot in said housing for receiving an end of said flexible substrate;

said plurality of contacts alignable with said pattern of conductors when said end is inserted into said slot;

a slider slidably engaging said housing;

a pressing plate on said slider slidably insertable in said housing through said insertion slot adjacent said flexible substrate;

a lever rotatably engaging said housing;

said lever camably engaging said slider to operate said slider between an inserted position and a closed position, whereby said lever provides a uniform engaging force along a width direction of said slider during an insertion of said flexible connector and minimizes required operating space; and at least one of said housing, said pressing plate, and said plurality of contacts having a shape which urges said pressing plate into firm contact with a surface of said flexible substrate as said pressing plate is inserted, whereby said pattern of conductors is urged into stable electrical contact with said plurality of contacts.

12. A flexible substrate connector, according to claim 11, further comprising:

said plurality of position slits having a pitch corresponding to a pitch of said pattern of conductors;

a contact section and an attachment section on each said contact;

said contact sections having a shape enabling elastic engagement with said pattern of conductors;

said plurality of contacts arrayed along a width direction of said housing in at least a first row;

a plurality of position slits in said housing adjacent said insertion slot; and each said attachment section engagable with each said position slit whereby said plurality of contacts are firmly retained in said housing in positions corresponding to said pattern of conductors.

13. A flexible substrate connector, according to claim 12, further comprising:

a first arm and a second arm on said slider;

a first and a second guide frame on said housing; and said first and said second guide frame slidably guiding said first and said second arm of said slider during insertion whereby said slider maintains an aligned relation between said pressing plate, said slider, and said housing.

14. A flexible substrate connector, according to claim 13, further comprising:

a first securing projection on each said first arm and said second arm;

a first securing slit on each said first and said second guide frame; and each said first securing projection slidably retained within each said first securing slit during operation whereby said slider is prevented from separating from said housing and said flexible substrate connector has a minimum size.

15. A flexible substrate connector, according to claim 14, further comprising:

a first and a second pivot arm on said lever;

a bounded hole in said housing opposite each said first and said second pivot arm;

a pivot shaft on each said first and said second pivot arm engaging said bounded hole and rotatably connecting said lever to said housing;

a front cam surface on each said first and said second pivot arm;

a rear cam surface on each said first and said second pivot arm;

a front follower surface on each said first and said second arm;

a rear follower surface on each said first and said second arm;

each said front cam surface engaging each said front follower surface during said insertion and driving said slider to said inserted position; and each said rear cam surface engaging each said rear follower surface during an opening operation of said slider, whereby said lever cam-ably engages said slider and operates said slider between said inserted position and said closed position and provides said uniform engaging force along said width direction of said slider within a minimum of space.

16. A flexible substrate connector, according to claim 15, wherein:

each said first and said second guide frame extend from opposite sides of said housing to an end adjacent said plurality of contacts whereby said plurality of contacts are protected from lateral damage during use and attachment to said circuit; and said lever at said closed position of said slider extending above said end of said plurality of contacts whereby said plurality of contacts are protected from vertical damage during use and attachment to said circuit.

17. A flexible substrate connector, according to claim 16, wherein:

said plurality of contacts is arrayed in at least said first and a second row along said width direction of said housing.

18. A flexible substrate connector, comprising:

a housing containing a plurality of electrically conductive contacts for electrically connecting to a printed circuit substrate;

said plurality of contacts elastically deformable in a direction perpendicular to an insertion direction;

said housing including an insertion slot formed for receiving a flexible substrate with a conductor pattern adjacent said plurality of contacts;

a slider slidably engagable with said housing;

said slider including a pressing plate member for slidably inserting in said housing;

lever means for urging said pressing plate member into said housing;

said pressing plate member pressing said plurality of contacts against said conductor pattern to secure firm electrical connection to said printed circuit substrate;

said pressing plate member providing resilient urging to said flexible substrate in a direction perpendicular to said insertion direction; and said plurality of contacts electrically connecting said flexible substrate to said printed circuit substrate whereby said flexible substrate is firmly retained in said housing with zero insertion force and is securely and elastically retained in said housing to ensure stable electrical contact.

* * * * *